US006543450B1

(12) United States Patent
Flynn

(10) Patent No.: US 6,543,450 B1
(45) Date of Patent: Apr. 8, 2003

(54) SURVIVAL MASK

(76) Inventor: John T. Flynn, 41 Hollywood Dr., Hastings on Hudson, NY (US) 10706

( * ) Notice: Subject to any disclaimer, the term of this patent is extended or adjusted under 35 U.S.C. 154(b) by 0 days.

(21) Appl. No.: 09/782,355

(22) Filed: Feb. 12, 2001

Related U.S. Application Data

(63) Continuation-in-part of application No. 09/163,043, filed on Sep. 29, 1998, now abandoned.

(51) Int. Cl.[7] ..... A62B 18/02; A62B 23/02; A62B 7/10

(52) U.S. Cl. ..... 128/206.19; 128/201.25; 128/201.28; 128/205.27; 128/205.28; 128/25.29; 128/206.12; 128/206.15; 128/206.24; 128/206.25

(58) Field of Search ..... 128/201.22–201.25, 128/201.28, 205.25, 205.27, 205.29, 206.12, 206.13, 206.15, 206.16, 206.17, 206.19, 206.21, 206.23, 206.24, 206.25, 206.28

(56) References Cited

U.S. PATENT DOCUMENTS

| | | | | | |
|---|---|---|---|---|---|
| 911,476 | A | * | 2/1909 | Cheesman | 128/206.17 |
| 2,665,686 | A | * | 1/1954 | Wood et al. | 128/206.12 |
| 2,898,908 | A | * | 8/1959 | Sovinsky | 128/206.17 |
| 2,910,979 | A | * | 11/1959 | Shanty et al. | 128/206.12 |
| 3,392,724 | A | * | 7/1968 | Cowley | 128/206.17 |
| 3,604,416 | A | * | 9/1971 | Petrahai | 128/206.17 |
| 3,731,678 | A | * | 5/1973 | Pyzel | 128/206.17 |
| 4,215,682 | A | * | 8/1980 | Kubik et al. | 128/205.29 |
| 4,296,746 | A | * | 10/1981 | Mason, Jr. et al. | 128/201.15 |
| 4,304,230 | A | * | 12/1981 | Seufert | 128/206.17 |
| 4,440,163 | A | * | 4/1984 | Spergel | 128/205.13 |
| 4,469,097 | A | * | 9/1984 | Kelman | 128/205.22 |
| 4,572,178 | A | * | 2/1986 | Takase et al. | 128/205.27 |
| 4,573,464 | A | * | 3/1986 | Yo | 128/206.15 |
| 4,771,771 | A | * | 9/1988 | Walther | 128/201.25 |
| 4,790,307 | A | * | 12/1988 | Haber | 128/206.19 |
| 5,143,071 | A | * | 9/1992 | Keusch et al. | 128/640 |
| H1316 | H | * | 6/1994 | McGuinness | 128/201.25 |
| 5,437,272 | A | * | 8/1995 | Fuhrman | 128/203.12 |
| 5,524,616 | A | * | 6/1996 | Smith et al. | 128/205.27 |
| 5,562,092 | A | * | 10/1996 | George | 128/201.25 |
| 5,617,849 | A | * | 4/1997 | Springett et al. | 128/206.24 |
| 5,640,952 | A | * | 6/1997 | Swann et al. | 128/206.17 |
| 5,664,566 | A | * | 9/1997 | McDonald et al. | 128/205.25 |
| 5,697,105 | A | * | 12/1997 | White | 2/206 |
| 5,921,239 | A | * | 7/1999 | McCall et al. | 128/205.25 |
| 6,176,239 | B1 | * | 1/2001 | Grove et al. | 128/206.24 |

FOREIGN PATENT DOCUMENTS

| | | | |
|---|---|---|---|
| DE | 4007965 | * | 9/1991 |

* cited by examiner

*Primary Examiner*—Aaron J. Lewis
*Assistant Examiner*—Joseph F. Weiss, Jr.
(74) *Attorney, Agent, or Firm*—Malin, Haley & DiMaggio, P.A.

(57) ABSTRACT

A simple, lightweight, easily deployable mask designed for use in modern fires. The mask substantially covers a wearer's face and includes a peripheral adhesive seal for preventing contaminants from effecting the wearer's visual or respiratory systems. The peripheral seal preferably comprises an adhesive band employing the skin adhesive commonly used in surgical masks. The adhesive band provides for closed attachment of the mask to the brow, the temporal area, cheek, over the jaw and down under the chin. The mask is anchored firmly to the ears of the wearer by resilient straps. Thus attached, the mask seals the eyes, nasal passages and mouth from the toxic external environment. The mask includes an intermediate seal separating the mask into separate visual and respiratory portions. The mask further includes a particulate filter impregnated with MOLECULITE® and one, or more frangible vials filled with perfluorocarbon saturated with oxygen which combine to filter out particulates, absorb toxic chemicals and provide a source of oxygen to the wearer.

7 Claims, 7 Drawing Sheets

SURVIVAL MASK

CROSS-REFERENCE TO RELATED APPLICATIONS

This application is a continuation-in-part of application Ser. No. 09/163,043 filed on Sep. 29, 1998 now abandoned.

BACKGROUND OF THE INVENTION

1. Field of the Invention

The present invention relates to survival masks for use in hazardous environments for protecting persons against the dangers of smoke and toxic gases, and more particularly, to a simple, lightweight and easily deployable mask designed for use by an individual within a hazardous environment such as a fire in emergency escape situations.

2. Description of Related Art

It is well known that toxic gases, inhaled by individuals, cause many fatalities in fire related emergencies. The loss of life and property resulting from fires in the United States and Canada occurs at twice the rate at which it occurs elsewhere in the developed world. Two-thirds of all fatal fires occur in single or two family homes. In addition to the 5,000 victims who perish annually in these fires, another 300,000 are hospitalized for prolonged medical and surgical care of their burns.

When occupants of a structure on fire are exposed to the fire byproducts, the first hazard encountered is usually smoke containing particulates and toxic gases which cause immediate visual degradation, obscuration, tearing and painful irritation of the eyes as well as the respiratory tract. This may be followed quickly by incapacitation due to pain, severe visual impairment and asphyxia as exposure continues. Fires burning in highly combustible structures tend to develop rapidly and the time available for escape is often limited to a few minutes before conditions become lethal due to the effects of toxic smoke and heat, so that survival depends on rapid egress. Visual obscuration and severe smoke irritation are important during the early stages in that they may reduce visibility and hence, the speed and efficiency of escape. People have been shown to be reluctant to enter smoke filled areas even if such areas are between them and the exit, and it has been found that movement is greatly reduced under these conditions. Once certain synthetic materials within the structure become heavily involved in combustion, the concentration of toxic gases, such as CO and hydrogen cyanide (HCN) increase rapidly throughout the structure causing rapid incapacitation of the occupants. Accordingly, the most significant problems encountered by occupants of a burning structure include the inhalation of toxic gases and the blinding effect of smoke.

Furthermore, fire and smoke related fatalities are frequently encountered during aircraft crashes, wherein the aircraft does not totally disintegrate upon impact. Many, if not all of the passengers, initially survive such low impact crashes only to find themselves engulfed in the resulting fire and smoke.

The National Transportation Safety Board has summarized the sequence of events in a commercial airline crash wherein the aircraft encounters a relatively low impact "belly-landing" as follows. Initially, the aircraft skids along the ground, causing fuel lines in the lower fuselage of the aircraft to be severed resulting in a fine mist spray of jet fuel into the baggage compartment. Typically, one of the wings impacts the ground-rupturing wing mounted fuel tanks resulting in additional spray of jet fuel. The jet fuel and associated vapor is typically ignited by a spark generated by the skidding aircraft resulting in a fireball which envelopes the fuselage. Within 30 to 60 seconds of the initial impact, the aircraft typically comes to a full stop with the fuselage generally level and intact. The flames enveloping the aircraft begin to melt the acrylic polymer windows and starts burning through the fuselage.

During the next minute, that is within approximately 60 to 120 seconds of the initial impact, a portion of the aircraft's interior is ablaze, and the cabin begins to fill with a dense, black, caustic smoke. The major identifiable gases which result in passenger incapacitation following combustion of the cabin interior materials include carbon monoxide (CO), hydrogen cyanide (HCN), hydrogen fluoride (HFl), hydrogen chloride (HCL), nitrous oxides ($NO_x$), sulfur dioxide ($SO_2$), ammonia ($NH_3$), acrolein (C—C—) and other hydro carbon compounds. The smoke and poisonous gases incapacitate the weak and elderly almost immediately and the remaining passengers shortly thereafter. Passengers who are still conscious blindly attempt to crawl toward an exit, which, quite typically, is not visible. Within approximately two minutes from the initial impact the cabin becomes a smoke filled inferno, and all passengers remaining in it are asphyxiated by smoke, poisoned by toxic gases or otherwise incapacitated.

There are indications that a substantial number of passengers in low impact aircraft crashes could be saved. Studies have shown that between 1969 and 1983, over 60% of the fatalities in such crashes were caused by suffocation due to the inhalation of toxic fumes, rather than by impact. Between 1985 and 1991 about sixteen percent (16%) of all United States transport aircraft accidents (thirty two (32) accidents) involved fire and twenty two percent (22%) of all fatalities (144 fatalities) resulted from fire/smoke toxicity. Laboratory analysis of post-mortem blood samples for the time period from 1967 through 1993 indicate that 360 individuals in 134 fatal fire related civil aircraft accidents had carboxyl hemoglobin saturation levels greater than or equal to 20%, with or without blood cyanide high enough to impair performance. A number of safety mask devices are known in the background art for use by persons in fire related emergencies. For example, U.S. Pat. No. 4,231,118, issued to Nakagawa, discloses a head and face-protecting hood. U.S. Pat. No. 4,466,432, issued to Wise, discloses an air-supplying hood which requires an external air supply to provide breathable air to the user. U.S. Pat. No. 4,793,342, issued to Haber et al., discloses an emergency smoke hood and breathing mask having an activated charcoal filter for removing smoke and/or toxic gases. U.S. Pat. No. 5,113,854, issued to Dosch et al., discloses a quick-donning protective hood assembly having a built-in oxygen generator. U.S. Pat. Nos. 5,186,165 and 5,315,987, issued to Swann, each disclose a filtering canister with deployable hood and mouthpiece, wherein the filtering canister includes various layered filtering material including activated carbon granules, a desiccant, a catalyst for the catalyzation of carbon monoxide to carbon dioxide and/or lithium peroxide for conversion of $CO_2$ to $O_2$, and electrostatically charged filters between the layers of filtering medium. U.S. Pat. No. 5,526,804, issued to Ottestad, discloses a complex self-sufficient emergency breathing device. U.S. Pat. No. 5,690,095, issued to Glynn et al., discloses an emergency escape breathing apparatus requiring a source of respirable gas.

The devices of the background art, however, do not disclose a simple, lightweight, easily deployable mask designed for use in modern fires. For example, U.S. Pat. No. 2,665,686 issued to Wood discloses a rather large device which is neither compact or flexible, and thus not well suited for storage within small storage compartments, handbags or carry-on luggage. In addition, it has been found that people, particularly when in distress, are reluctant to completely cover their heads with hooded devices.

Hoods of the prior art are bulky, cumbersome to put on, require up to five minutes to do so, contain huge amounts of dead space (the space occupied by a women's hair style, for example), are difficult to seal around the neck and contain as part of the apparatus a canister for filtration and an exogenous supply of $O_2$. Hoods are for trained personnel, i.e., flight attendants, firemen, paramedics, rescue personnel, with responsible roles to play in emergency fire situations and long durations of exposure anticipated in carrying out those responsibilities.

Conversely, the mask of the present invention is specifically designed to provide the frightened lay person trapped in these awful environments with something they can use easily and will provide them with clear vision, clean breathable air, scrubbed of irritant smoke particles and toxic gases for a limited period of time.

Accordingly, with the devices of the background art, any toxic smoke which enters the mask, either through a faulty seal or faulty filtering apparatus, will result in irritation of the wearer's eyes. Many fatalities can be prevented in fire related emergencies if a person's eyes were protected from exposure to toxic smoke and if filtered breathing air were available so that the person could avoid the harmful effects of toxic smoke while escaping. Therefore, there exists a need for a flexible, compact lightweight mask for providing both respiratory and visual protection in modern fire environments.

BRIEF SUMMARY OF THE INVENTION

A simple, light-weight, easily deployable survival mask designed for use in modern fires. The survival mask of the present invention is made of a simple design, resembling a surgical mask, and is designed to be used by the lay person, with no previous training or experience in emergency situations such as an aircraft fire or a home, hotel, or high rise building fire. The mask substantially covers a wearer's face and includes a peripheral adhesive seal for preventing contaminants from effecting the wearer's visual or respiratory systems. The peripheral seal preferably comprises an adhesive band employing the skin adhesive commonly used in surgical masks. The adhesive band provides for closed attachment of the mask to the brow, the temporal area, cheek, over the jaw and down under the chin. The mask is secured firmly to the wearer's face by adjustable, resilient straps detachably affixed to opposing sides of the mask body such as VELCRO™.

The adhesive band provides for closed attachment of the mask to the brow, the temporal area, cheek, over the jaw and down under the chin. The mask is anchored firmly to the head of the wearer by resilient straps. Thus attached, the mask seals the eyes, nasal passages and mouth from the toxic external environment.

The mask is comprised of an upper, visual portion and a lower, respiratory portion. A further feature of the mask is the provision of an intermediate seal separating the upper, visor portion and the lower, respiratory portions of the mask to form a separate sealed visual compartment and a sealed breathing compartment. The upper portion defines a visual compartment including a substantially transparent section and is separated from the breathing compartment by a soft metal band with an adhesive seal which is shaped to conform to the nasal bridge and orbital rim. The proper orientation of the mask is easily identified by the presence of a highly visible colored outline around the periphery of the mask. Instructions, a photograph, or a drawing can be included with the mask packaging to provide guidance to the user as to which colors correspond to which facial feature. Further instructions can instruct the user how to fracture the vials containing the perfluorocarbon solution, contained in the respiratory portion of the mask, which provides an independent source of oxygen to the user.

The upper visual compartment extends outward from the eyes and protects the eyes and is designed to fit over eyeglasses of any size so that the eyeglasses do not have to be removed to wear the mask.

The upper visual compartment provides protection for the delicate epithelial lining of the cornea and the conjunctiva from the irritant, particulate-laden smoke and accompanying toxic gases such as CO, HCN, etc., in the ambient atmosphere of a fire. Failure to protect the eye tissue from these toxins can result in a profound loss of vision, so necessary to guide successful escape from a fire. The adhesive band molds around and seals the eyeglass temples.

The thermostability of the mask material offers protection from fogging due to the ambient heat of the surrounding area, while the isolation of the visual portion from the respiratory portion of the mask protects fogging due to the water vapor of the user's exhaled breath. In addition, treatment of the visual portion's inner surface of clear plastic with de-fogging agents will further reduce fogging and result in clearer vision.

The lower portion of the mask defines a breathing compartment. The mask is impregnated with a particulate filter such as HOPCALITE® or MOLECULITE® granules. MOLECULITE® is an Oxygen catalyst comprised of a mixture of Copper Oxide and Manganese Oxide. The particulate filter provides for the removal of atmospheric dust thereby protecting the wearer's respiratory system from exposure to airborne particles. Preferably, MOLECULITE® particles of nanoparticle size ($10^{-9}$ m) in diameter are used. The MOLECULITE® functions to reduce and absorb the levels of various toxic gases such as CO, $CO_2$, HCN, HCl, $H_2S$, $SO_2$ and olefins (hydrocarbon fragments from the burning of plastic).

Also within the respiratory portion of the mask are one or more frangible vials, each containing a source of molecular oxygen for breathing, dissolved as solute in a supersaturated solution of perfluorocarbon (PFC) liquid. The perfluorocarbon-oxygen liquid is initially contained in thin walled glass ampules embedded within flanking pouches surrounding a respiratory cup. The respiratory cup is generally comprised of melt blown electret microfibers, similar to that disclosed in U.S. Pat. No. 4,215,682 issued to Kubik et al. and U.S. Pat. No. 3,971,373 issued to Braun, each incorporated herein by reference.

As soon as the mask is opened from its packaging, the glass ampules become ruptured, and the breathing compartment is flooded with the perfluorocarbon liquid which is absorbed by the particulate filter. The oxygen is released into the body of the mask by physical diffusion immediately upon rupture of the vials. The particulate filter, MOLECULITE® and perfluorocarbon, function to filter out particulates, absorb toxic chemicals and provide a source of oxygen to the wearer. The mask is easily applied in a matter of 30 to 60 seconds. The major and unique function then of the PFC is as a carrier of oxygen readily available for breathing as soon as the ampules are ruptured and the PFC enters the respiratory cup.

After release from its carrier vials, the liquid PFC releases its dissolved oxygen and assumes its second function, that of a non-toxic, non-irritant, biologically inert, well tolerated wetting agent to help trap particulate material present in the dense acrid smoke of a home, hotel or aircraft cabin, in the respiratory portion of the survival mask.

The mask is capable of being folded into a very compact storage configuration, such as a sterile plastic and fire resistant Peel Pack™ container, and will easily fit into a women's purse, a man's jacket, a briefcase or the storage compartment behind aircraft passenger seats.

Upon removal from its container, the mask is easily applied by utilizing the color-coded flanges corresponding to the parts of the face to which each part is applied. In fact, the color-coding scheme is critical since once the mask is folded and stored it must be unfolded and properly configured on the user's face. The color-coding scheme therefore allows the layperson to properly place the mask on his or her face, normally a trivial maneuver, yet which becomes alarmingly more difficult under the duress of hazardous conditions. Because the prior art protective hoods are rigid and inflexible, and therefore cannot be folded for storage purposes, there is no need for a color scheme of the type utilized by the present invention.

The flexible design of the mask fits the size and conformation of differing facial anatomy and adheres to the skin surface of the face, brow and chin of the wearer by means of moldable flanges of elastomeric material impregnated with a non-stringy hydrophilic adhesive gel. The visual and respiratory compartments are separated from each other by that same impregnated elastomeric material contained in a soft aluminum band moldable to the contour of the nasal bridge to prevent leakage between the two compartments. Finally, the mask will be firmly secured to the head by any typical securing means, preferably two soft VELCRO™ straps adapted to fit any head size.

Accordingly, it is an object of the present invention to provide a simple, lightweight, easily useable survival mask designed for use by any individual within a hazardous environment such as a fire in emergency escape situations.

A further object of the present invention is to provide a survival mask having an intermediate seal separating upper and lower portions of the mask to form a separate sealed visual compartment and a separate sealed breathing compartment.

Yet another object of the present invention is to provide a survival mask with an easy-to-use color-coded scheme to enable the user to properly configure the mask on his or her face.

Still another object of the present invention is to provide a survival mask wherein the wearer's respiratory system is protected by a MOLECULITE®-impregnated particulate filter saturated with oxygen-loaded perfluorocarbon.

Another object of the present invention is to provide a small, packagable, portable and easily accessible survival mask that can easily stored, transferred, removed and deployed when needed.

In accordance with these and other objects which will become apparent hereinafter, the instant invention will now be described with particular reference to the accompanying drawings.

DETAILED DESCRIPTION OF THE INVENTION

Figure 1:
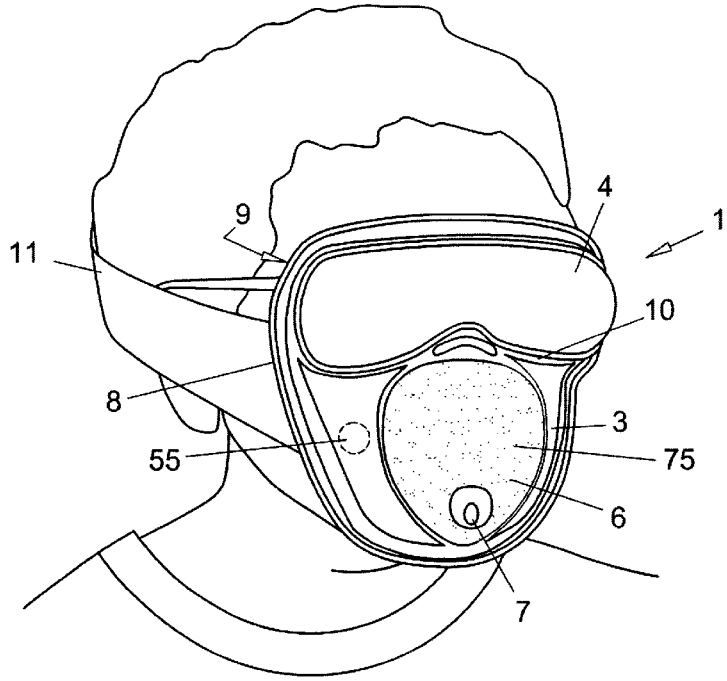
FIG. 1 is a front, perspective view of the survival mask of the present invention on the face of a user, illustrating the general arrangement of its components.

With reference to the drawings, and in particular FIG. 1, there is depicted a simple, flexible, light-weight, easily deployable mask, partially covering the face of a user, very similar in appearance to a surgical mask, to be used, for example, by passengers in an aircraft fire or persons in a home, hotel or high rise fire, to facilitate rapid egress by providing clear vision and breathable air.

FIG. 1 shows a front, perspective view of the mask in place on a subject, illustrating the major features of the survival mask of the present invention. The mask assembly 1, includes an upper visor portion 2 and a lower respiratory portion 3. The subject is shown wearing generously-sized spectacles completely covered by a bubble configuration 4, of visor portion 2. In the mask's lower, respiratory portion 3, flanking pouches containing frangible vials 55 are shown which contain a perfluorocarbon solution (PFC-$O_2$). Vials 55 are covered with soft fluff and mesh covered pouches to protect the wearer from injury after breakage of the glass vials. The mask itself is lined on its surface with flame retardant cloth.

After breakage of the ampules releasing the PFC-$O_2$ solution, the liquid quickly soaks a cup shaped respiratory cup 6, within respiratory portion 3, filled with oxygen-rich PFC of low surface tension (to permit ready physical diffusion of the $O_2$). A one-way outlet valve 7 within cup 6 permits the ready escape of expired air exhaled by the wearer. The entire mask 1, is adapted to the skin of the user's face by a soft, flexible flange 8, made of the same material as visor 2 and situated along the perimeter of the mask.

Along the periphery of mask 1, on its inner (skin) surface, is an adhesive seal 9, coated throughout with a soft elastomeric material to promote easy adaption to facial contour and to prevent airborne contaminants from effecting the wearer's visual or respiratory systems. The elastomer is coated with a hydrophilic gel of the type disclosed in U.S. Pat. Nos. 5,143,071 and 5,354,790, incorporated herein by reference, adhesive and is color coded. The color code is shown for illustrative purposes on the outer surface (away from the face) of mask 1, but in fact, the elastomer, the adhesive gel and the color coding are on the inner surface as illustrated in later drawings.

The color coding can be any type of coding wherein different colors appear on different portions of the mask and the user can follow the scheme to properly place the mask on his or her face. One type of color coding scheme uses red on visor portion 2, green on the seal 10 between upper visor portion 2 and lower respiratory portion 3 of mask 1, and violet for the respiratory portion 3. Seal 10, extends laterally across the wearer's cheek and nose thereby dividing mask 1 into discrete upper visual portion 2 and lower respiratory portion 3. The portion of seal 10, between visor 2 and respiratory portion 3 is gas-tight and liquid-tight in order to protect the user's eyes from the effects of foreign substances. As should be apparent, seal 10 prevents any contaminants which may find its way into respiratory portion 3, from entering visual portion 2. Accordingly, a complete peripheral seal is formed around the wearer's eyes and spectacles worn by the wearer. Furthermore, seal 10 may include a soft metal band shaped to conform to the nasal bridge and orbital rim of the wearer.

Holding mask 1 firmly in place are two VELCRO™ straps 11, one on each side of the user's head, anchored by firm stitches (or welds) to the cloth body of the lower portion of mask 1 and firmly and easily clasped to the user's head. This permits the easy adjustment of the mask in its preferred embodiment to any head size. Traditional hook and loop fasteners 80*a* and 80*b* may be used to help secure the straps 11 to each other. It is within the spirit of the invention to use any appropriate fastening means to detachably and adjustably secure the mask to the user's head.

Figure 2A:
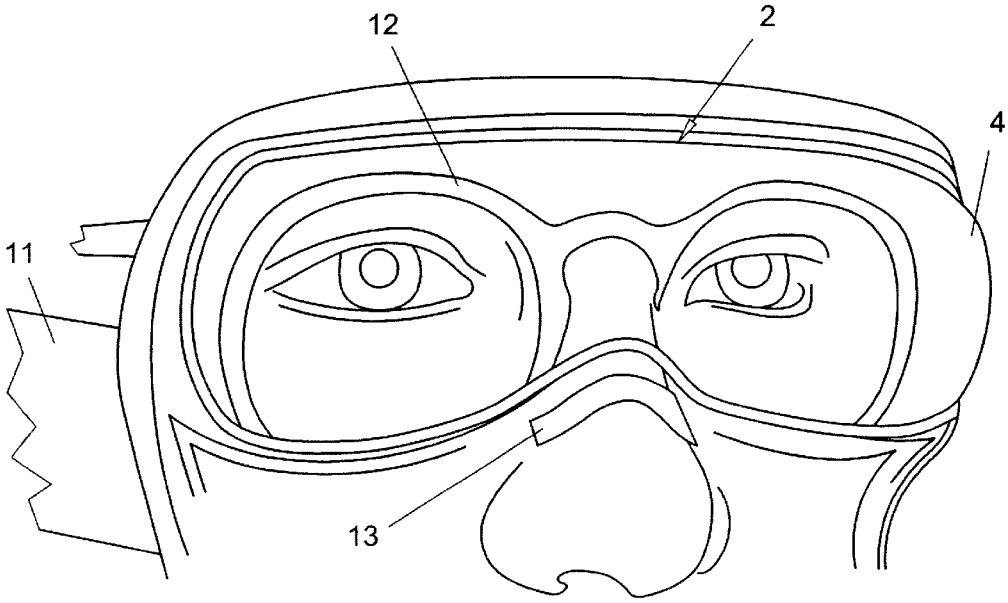
FIG. 2A is a front view of the upper visor portion of the mask illustrating the "bubble" configuration to allow comfortable clearance of spectacle frames worn by the user.

FIG. 2A is a frontal illustration, displaying a detailed view of visor portion 2 of mask 1 as it is worn by the user. Visor portion 2 is preferably fabricated from material which is light-weight, transparent and heat resistant. The "bubble" design, shown as 4, which provides the wearer ample room for clearance of the largest horizontal and vertical diameters of optical frames commercially available (48×45 mm), is clearly shown. Visor 2 is made of a molded, thin, flexible sheet of thermostable KAPTON®, TEFLON® or similar material. It is molded to a desired shape to permit soft "bubbles" to be draped over the wearer's lens frame and the nasal bridge to accommodate the protruding outer curved surfaces of a spectacle's frame, shown as 12, to be comfortably worn under plastic visor 2. The unique pliable, resilient and form-fitting characteristics of the mask of the present invention allow the user's eyeglasses and temples of the eyeglass frame to be covered while maintaining a tight seal over the user's face.

Figure 2B:
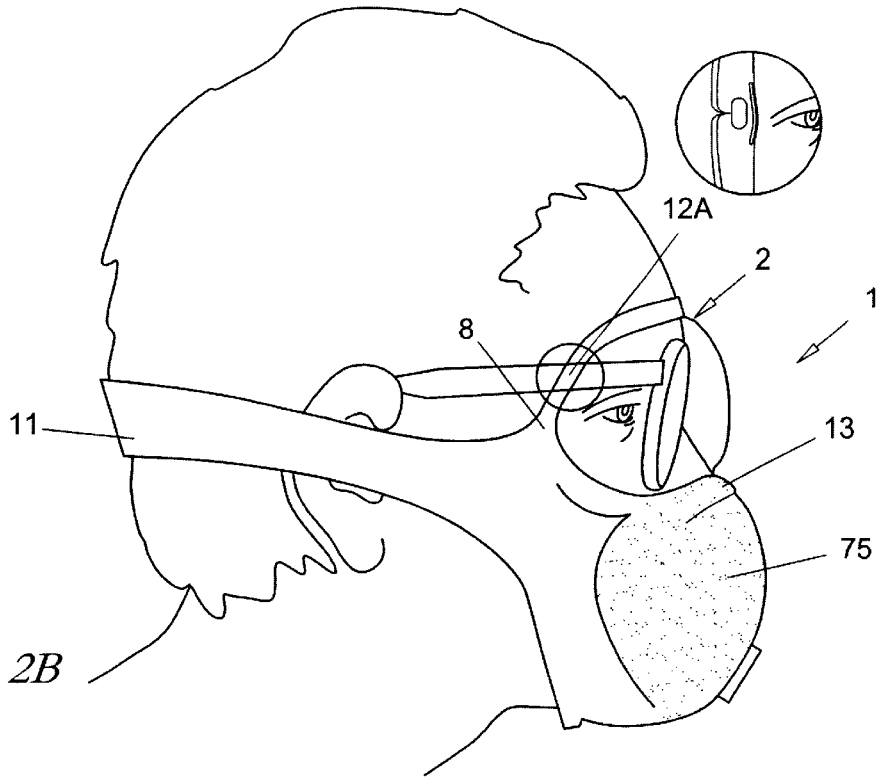
FIG. 2B is a side view of the survival mask of the present invention showing the separate visor and respiratory compartments including detail of how the temples of any eyeglass design are included in the seal.

In the side view of FIG. 2B, the temple or bow arms of the eyeglasses are sealed by flange 8 of mask 1. This seal is continued down to the skin of the face thereby completing the sealing of the visual compartment. The flexible flange of the survival mask allows the mask to be sealed over the temple of the glass frames while maintaining tight adhesive contact to the skin. The temples of the eyeglasses exit through slots 12A along the sides of mask 1 externally to follow the natural course over the ear lobes. The seal provides protection to preserve the integrity of visor 2 from the outside atmosphere. The visor's flange 8, and, in fact, the entire edge of mask 1 is continued as a flange of soft, flexible KAPTON®, TEFLON® or similar material, 3 mm in width and flexible in design to fit the facial features of the brow, temple, cheek and nasal bridge and chin of the user. Flange 8 is part of visor 2 but in its continuation below is bonded to the fabric of the mask at its edges by stitches. Flange 8 is covered throughout on its inner surface with seal 9, a soft elastomeric material, color coded for ease of application as red, for example, for the brow and the temple regions.

The surface of the colored elastomer is coated with an hydrophilic, non-stringy adhesive gel specially adapted for skin use. The area where visor 2 is in contact with the nasal bridge, is made more secure to the unique anatomy of each person's face by means of a soft metal band 13, generally comprised of aluminum or any other similar soft metallic alloy.

When attached, mask 1 seals the eyes, nasal passages and mouth from the toxic external environment. It is contemplated that a multitude of one-size-fits-all mask sizes would be available. For example, mask dimensions could be scaled to fit the facial dimensions of: the average infant (≦1 year of age); the average child (2–5 years of age); and the average adult.

Figure 3:
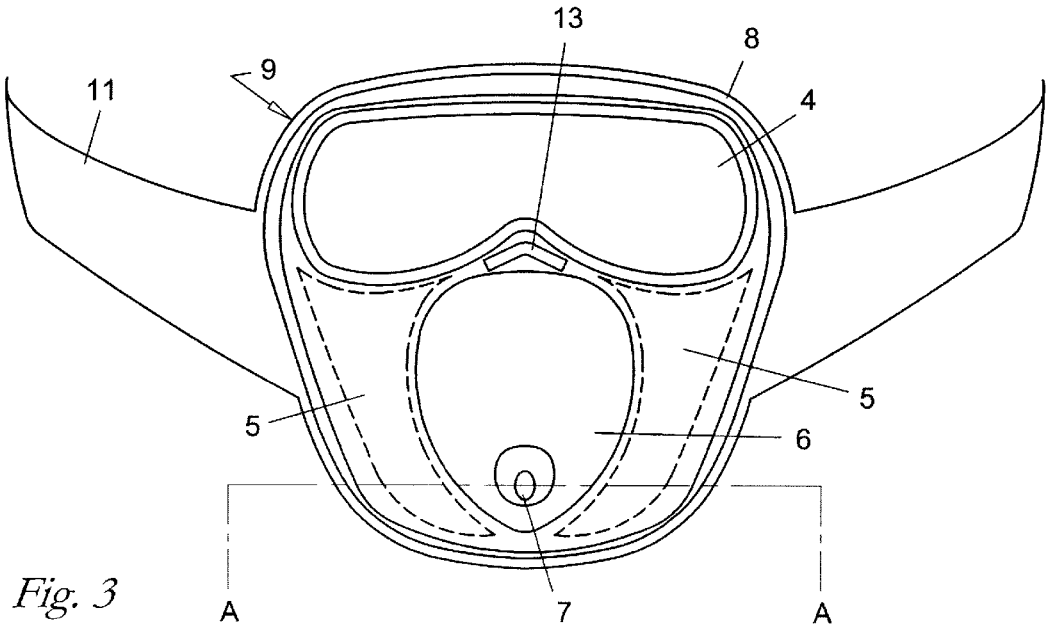
FIG. 3 is a detailed front view of the survival mask of the present invention.

FIG. 3 is a front view of mask 1 illustrating flange 8. Flange 8 is embodied in visor 2 and respiratory portion 3 of mask 1 where it separates the visual from the respiratory portions with an air and liquid tight seal.

Flange 8 is comprised of a backing of KAPTON® and/or TEFLON® or similar material covered by a soft elastomer, common in the art, which is molded to the facial surface of flange 8. It is impregnated with a hydrophilic, non-stringy adhesive 15, and color-coded for ease in facial orientation and placement. This can be seen more clearly in FIG. 10.

FIG. 3 illustrates flange 8, and its inner surface seal 9, as applied to the skin surface with its hydrophilic gel, and is color-coded according to facial location on the surface of the soft elastomer, applied to the skin surface.

FIG. 3A is a front view of mask 1 illustrating flange 8. Flange 8 is embodied in visor 2 and respiratory portion 3 of mask 1 where it separates the visual from the respiratory portions with an air and liquid tight seal.

FIG. 3B is a detail of flange 8, showing its layered details. Flange 8 is comprised of a backing of KAPTON® and/or TEFLON® or similar material covered by a soft elastomer 14, common in the art, which is molded to the facial surface of flange 8. It is impregnated with a hydrophilic, non-stringy adhesive 15, and color-coded for ease in facial orientation and placement.

FIG. 3C illustrates flange 8, and its inner surface seal 9, as applied to the skin surface with its hydrophilic gel, and is color-coded according to facial location on the surface of the soft elastomer 14, applied to the skin surface 16.

Figure 4:
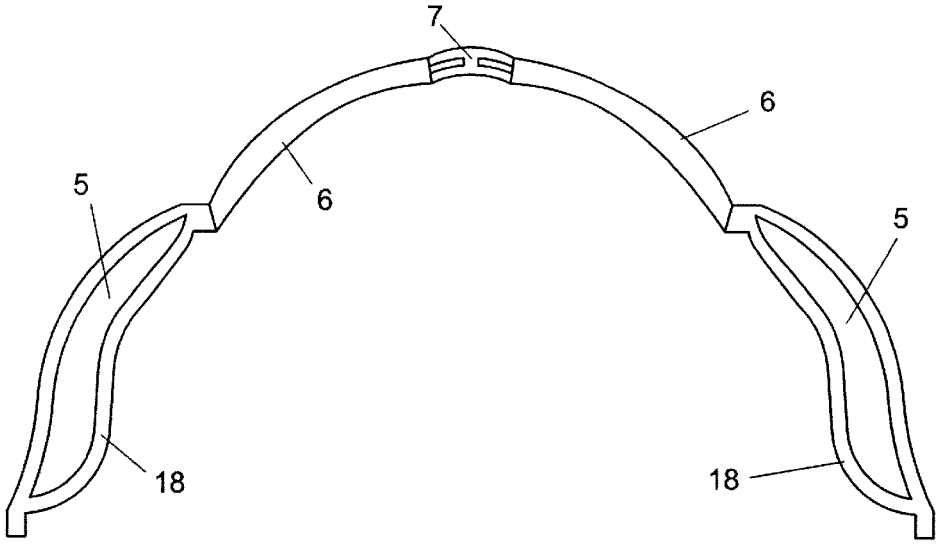
FIG. 4 is a cross sectional view of the lower respiratory portion of the survival mask of the present invention, through its central portion.

FIG. 4 shows mask 1 just below the mid-plane 17, of respiratory cup 6 including a cross sectional view of lower respiratory portion 3. The central part of portion 3 is occupied by the cup-shaped molded respiratory cup 6 (shown clearly in FIG. 1) with a one way expiratory valve 7, and its layered design of electret fibers. Flanking central cup 6 are two soft, fluff-filled and mesh covered pouches 5, which contain the glass shards after frangible vials 55 have been ruptured. Vials 55 contain the PFC-$O_2$ solution 19, which is dispersed throughout the mask upon rupturing. Central respirator cup 6 is fabricated from melt-blown fibrous charged electret fibers 20, to which are adhered nanoparticles of MOLECULITE® 75. Respirator cup 6 is stitched or welded to flanking pouches 5, containing the frangible vials of PFC-$O_2$ solution.

The rational for providing the PFC-$O_2$ liquid is two fold:

1) it is a specially prepared supersaturated solution to provide a readily available source of $O_2$ for breathing during escape maneuvers; and
2) as a liquid it serves to trap smoke particles which are particular irritants to the respiratory track when inhaled.

Figure 5:
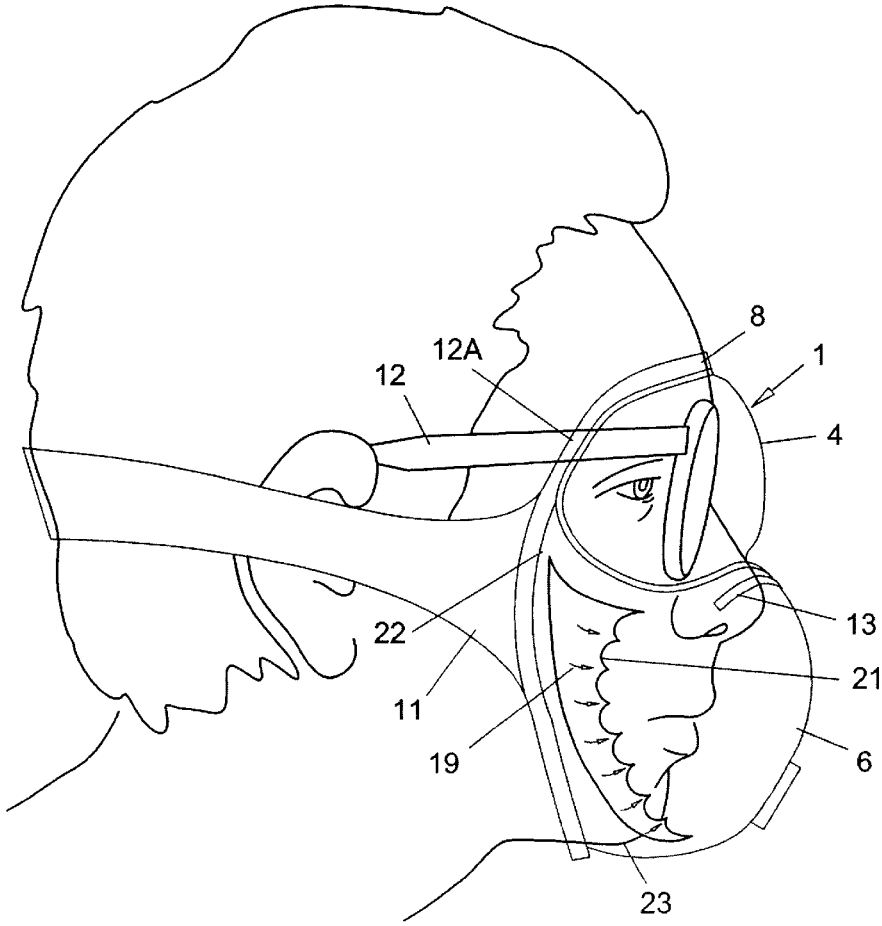
FIG. 5 is a detailed cut away side view of the mask of the present invention showing the cup-shaped portion of the respiratory compartment on the face of the user.

FIG. 5 is a side view of mask 1 showing flanking pouches 5 after rupture of the frangible vials 55, containing the PFC-$O_2$ liquid 19, and its route of egress after rupture. The joint is stitched or welded at 21, in a semicircular fashion to permit the unhampered flow of the liquid (shown by the arrows) from the pouch into the cup to saturate it with the oxygen-rich PFC. The entire lower respiratory portion is firmly sealed to the skin by the previously described seal 9, above the visor, laterally at the user's cheek 22, and inferiorly from the user's chin 23, thereby preventing contaminants from entering the body of the mask from outside.

Figure 6:
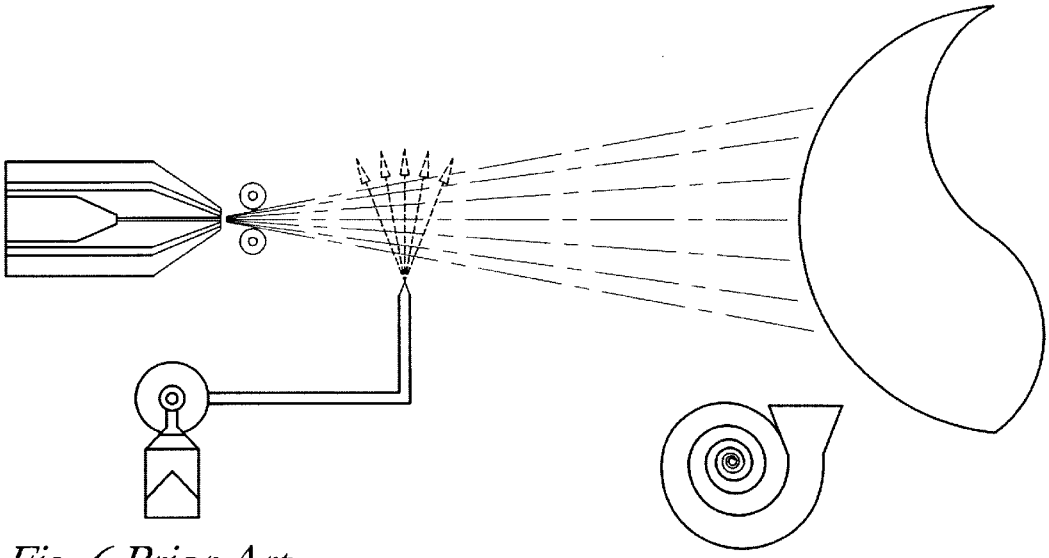
Fig. 6 Prior Art
FIG. 6 illustrates the technique used to create the melt blown electret fibers blown on the central cup surface mold of the respiratory portion of the survival mask.

FIG. 6 shows an apparatus and method for preparing a fibrous mat of melt blown electrets comprising the mask of the present invention and adapted from U.S. Pat. No. 4,215,682 issued to Kubik, et al. The complete details of the production of this apparatus can be obtained by consulting the Report No. 4364 (May. 25, 1954) of the Naval Research Laboratories, cited by Kubik, col. 4, line 12.

The apparatus includes a die 25, consisting of a row of narrow, side by side orifices 26 for the extrusion of molten material, here polypropylene or similar material, with slots 27 on each side of the row of orifices through which a gas, usually air, is blown at high velocity. The stream of molten fibers 28, can be bombarded by charged particles immediately as they exit the die orifice by placing one or more sources of such particles adjacent to the die orifice 29. As shown, each source consists of an electrical conductor 30, connected to a high voltage source, and positioned within a metal shell 31 which in turn is connected through a resistor to ground. Placement of the charge particle sources just beyond the die face 32, assures that the fibers are in the molten or near molten condition assuring a high rate of placement of the charge carriers within the fibers.

After passing through the field of charged particles, a stream of nanoparticles of MOLCULYTE™ 34, is next pumped into the stream of gas-driven fibrous electrets as described in U.S. Pat. No. 3,971,373 issued to Braun. The source of the nanoparticles 35, is an apparatus for feeding the metallic particles, monitored by a metering device 36, through which the particles pass into a conduit at a predetermined rate. An air impeller 37, then forces air through a second conduit 38, which draws the particles forward and forces them through a nozzle and into the charged stream of fibrous electret 28. The amount of nanoparticles entering in the stream is controlled by the rate of air flow through impeller 37 and the rate at which particles pass the metering device 36. The particles adhere to the electret fibers by apposition and contact. The stream of molten fibers are cooled by the air stream and carried to the target, in this case a mold of the cup-shaped respirator cup 39.

The target mold is moved back and forth through an angle to fully cover the surface with an adequate layer of fibrous electret, with surface charge 33, and nanoparticles of MOLCULYTE™ 34, each to fulfill a separate function; the surface charge to attract particulate material in the smoke and trap it in the fibrous electret; and the nonoparticles to react with and render harmless the toxic gases alluded to previously. The withdrawal apparatus 40, for the removal of the air, can be positioned at any convenient place away from the deposited fibers.

Figure 7:
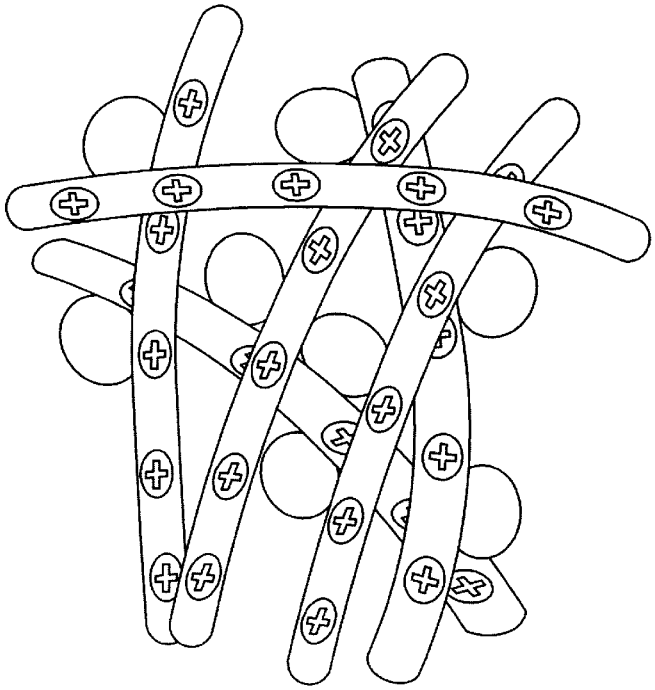
Fig. 7 Prior Art
FIG. 7 is a blown up view of the electret fibers molded over the cup shaped mask with the adherent nanoparticles (enlarged for emphasis), adsorbed or in contact with the fibers.

FIG. 7 is an enlarged view of the fibrous electret, adapted from U.S. Pat. No. 6,102,039 issued to Springett et al. included herein by reference. Surface charge 33, and nanoparticles 34, are deposited on the surface of the mold 41. Nanoparticles 34, are enlarged for emphasis. This figure portrays the typical charge and particle loaded web employed in the assembly of respirators.

Figure 7A:
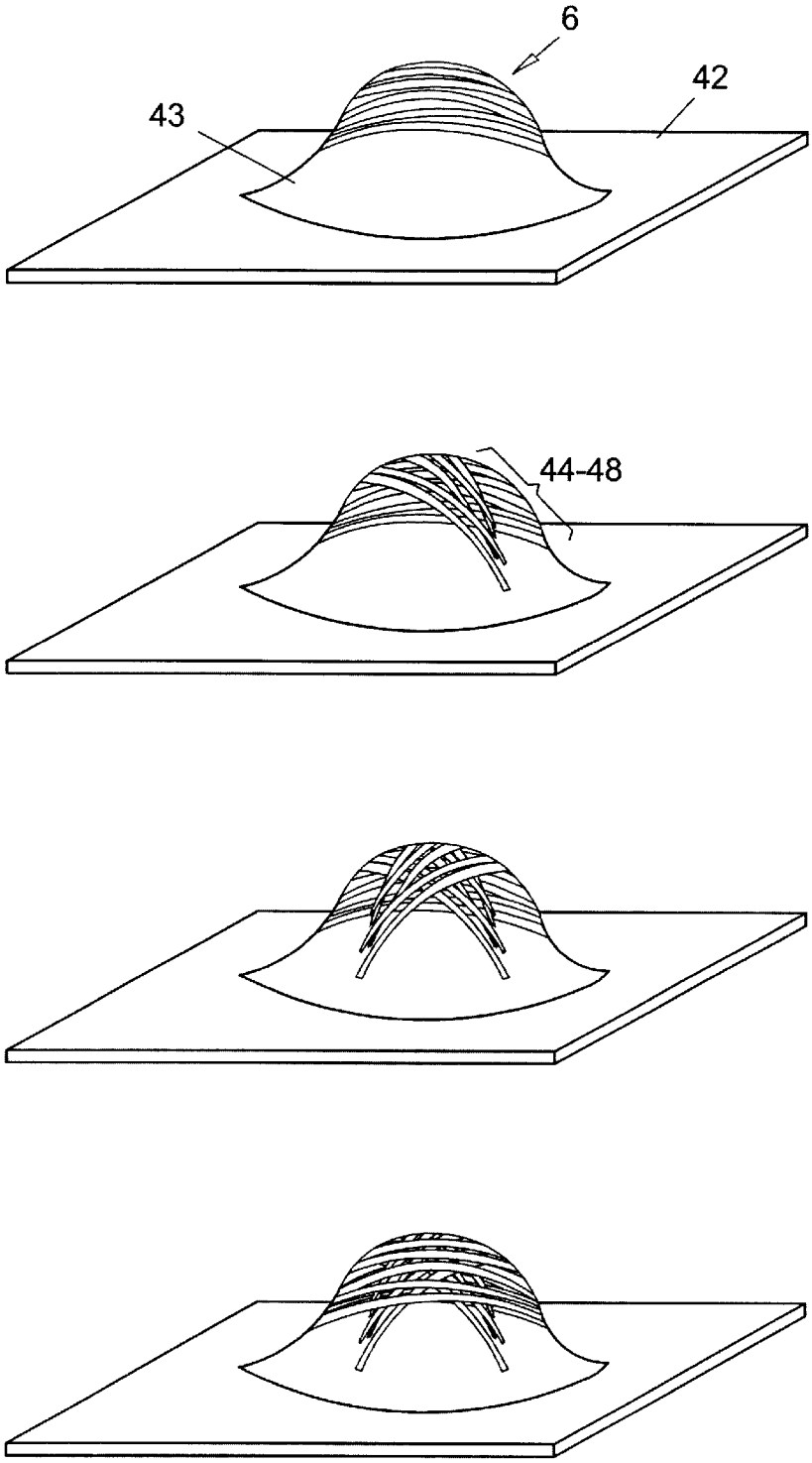
FIG. 7A shows in detail the assembling of the layers, of the surgical mask of the present invention.

FIG. 7A shows in detail the assembling of the layers of respiratory cup 6, the outermost mold or shaping layer 42 having a smooth outer surface that can be molded separately from the other layers. Layer 43 is a formless filtration layer designed to trap particles which may become dislodged from the charged particle layers on the inhaled air stream. Layers 44–48 are five ribbed layers each formed of a charged electret 33, containing nonoparticles 34, formed as described in FIG. 6.

Therefore, respirator cup 6 retains a cup-shape mold and does not flatten in the unconstrained state. In the course of the fabrication process, the cup can be modified to permit the insertion of outlet (expiratory) valve 7 (FIGS. 3 and 4), to permit free egress of expired air. The cup itself is edge-welded to flanking pouches 5, containing PFC-$O_2$ supersaturated solution, with sufficient space to permit free egress of the solution into cup 6. The cup layers need not all have the same degree of air permeability as long as they collectively have sufficient permeability to permit easy inhalation and exhalation by the wearer during use.

Figure 8:
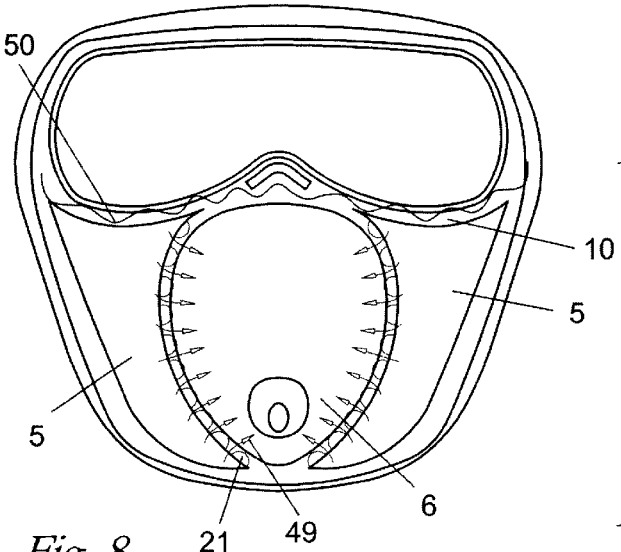
FIG. 8 is a detailed rear view of the two stitches or welds between the respiratory cup and the flanking pouches, and the respiratory cup and pouches together and the flange of the visor portion.

FIG. 8 is a detail of the two stitches, or welds, between respiratory cup 6, and flanking pouches 5, on the one hand, and cup 6 and pouches 5 together, and the flange of seal 10. In the former, the weld 21, is discontinuous to permit easy egress of the PFC-$O_2$ solution into cup 6 as marked by the arrows 49. In the latter, the weld is a continuous sinusoid 50, designed to completely seal off the two compartments from each other.

Figure 9A:
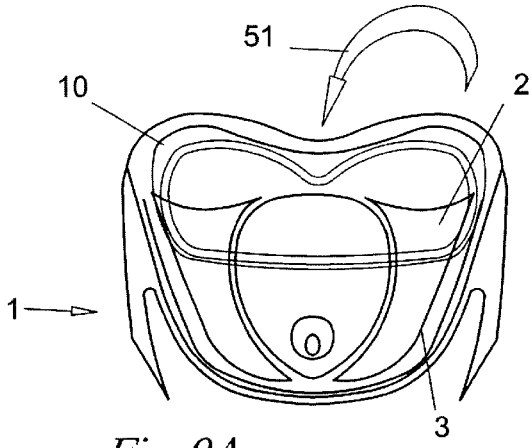
FIGS. 9A–9D illustrates the flexibility and storage characteristics of the survival mask of the present invention.
Figure 9B:
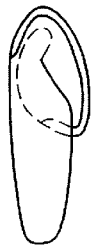
Figure 9C:
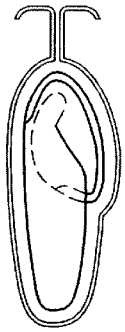
Figure 9D:
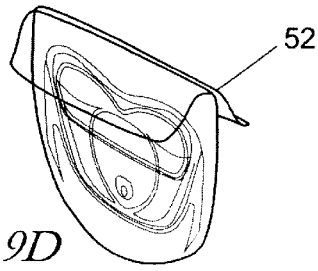

FIG. 9*a* illustrates the downward fold 51, of visor 2 just below the edge of seal 10, giving rise to a gentle bilobed curve to the upper edge of the fold due to the curve of seal 10, over the nasal bridge. The fabric of the upper part of respiratory portion 3 is soft and flexible in order to permit this. After folding, mask 1 is placed in the Peel Pack™ 52, as shown in FIGS. 9B through 9D.

The downward fold of visor portion 2 introduces an elastic resistance in the folded visor so that, in a typical example, when the package is opened, the visor with its red color code recoils from its packaged configuration and springs out first, followed by the green color-coded seal over the nose, followed lastly by the violet respiratory portion.

Figure 10:
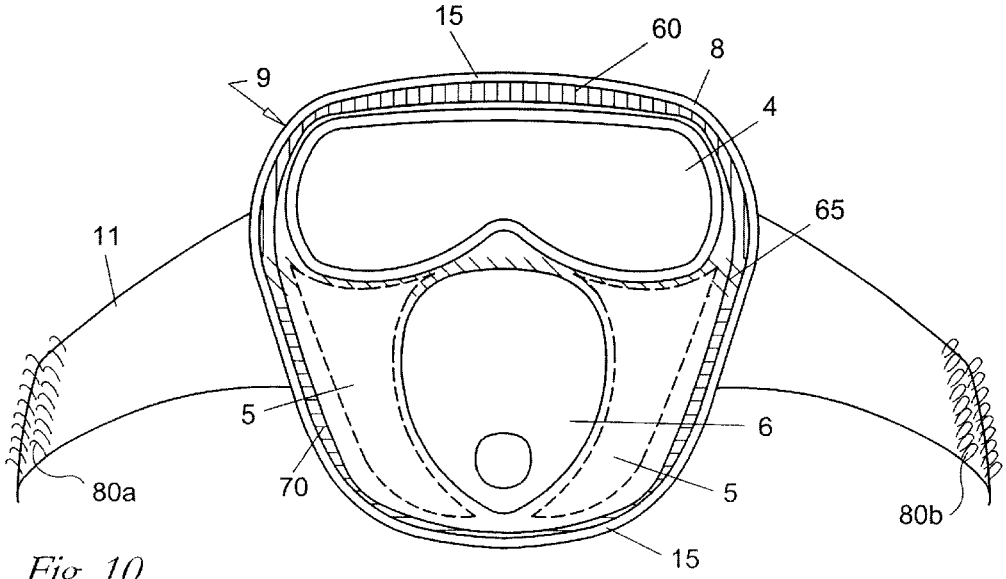
FIG. 10 is a rear view of the mask illustrating the color-coding scheme and the adhesive means.

FIG. 10 illustrates the color-coding scheme used in the present invention. Each portion of the inside perimeter of mask 1 is a certain color (as indicated by 60, 65 and 70). In this fashion, mask 1 can easily and properly be donned during a catastrophic event, such as a fire, when the user may be under great duress. Adhesive material 15, around the inner perimeter of mask 1, provides an airtight seal of the mask to the user's face.

One method of deploying the mask of the present invention would be for the user to place the mask over his or her knee and provide a sharp hand clap to break the frangible vials, releasing the PFC-$O_2$ liquid and retaining the shattered glass fragments within the pouches. The mask is fully operational and ready to be placed over the eyes, nose, and mouth and secured in place by the seals and the VELCRO™ straps. Upon deployment of the mask, the proper orientation of the mask can be easily identified by the presence of the highly visible colored outline around the mask.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A survival mask for use in hazardous environments for protecting a user from smoke and toxic gases, comprising:

a flexible mask body defining a visual portion and a respiratory portion, said mask body including a peripheral airtight seal having adhering means to allow said mask body to adhere to the user's face, said mask body capable of being folded to provide a compact storage configuration, said flexible mask body being adaptable to fit the size and shape of different facial anatomy;

said mask body including an intermediary airtight seal to separate said visual portion from said respiratory portion thereby preventing any contaminants to travel from said respiratory portion to said visual portion, said visual portion including a transparent window for covering the eyes of the user;

said respiratory portion including filter material and further including a self contained, supplementary oxygen supply; and means for securing the mask body to a user's face;

wherein said self-contained supplementary oxygen supply comprises one or more frangible vials containing perfluorocarbon, where upon fracture of one or more of said vials, said perfluorocarbon assures immediate availability of oxygen to the user.

2. The survival mask of claim 1 wherein said perfluorocarbon is a carrier of a supersaturated solution of oxygen, said perfluorocarbon having a low surface tension to permit ready physical diffusion of oxygen.

3. The survival mask of claim 1, wherein, before rupture, one or more vials of dissolved oxygen are embedded within flanking pouches surrounding said respiratory portion.

4. The survival mask of claim 3, wherein said respiratory portion further comprises a respiratory cup-shaped apparatus for retaining said dissolved oxygen after rupture.

5. The survival mask of claim 4 further comprising a one-way outlet valve within said cup-shaped apparatus to permit free egress of expired air.

6. The survival mask of claim 4 wherein said respiratory cup-shaped apparatus is comprised of electret fibers.

7. A survival mask for use in hazardous environments for protecting a user from smoke and toxic gases, comprising:

a flexible mask body defining a visual portion and a respiratory portion, said mask body including a peripheral airtight adhesive seal having adhering means to allow said mask body to adhere to the user's face, said mask body capable of being folded to provide a compact storage configuration, said flexible mask body being adaptable to fit the size and shape of different facial anatomy;

said flexible mask body including an intermediary airtight seal to separate said visual portion from said respiratory portion thereby preventing any contaminants to travel from said respiratory portion to said visual portion wherein said peripheral and intermediary seals are each comprised of an adhesive band of soft elastomer material made from hydrophilic gel to provide an airtight seal of the mask to the user's face and to provide easy adaption to facial contour and to prevent airborne contaminants from effecting the user's visual or respiratory systems;

said visual portion extending outward from the user's face around the edge to sufficiently fit over eyeglasses, frames and temples to provide a tight seal to the visual compartment when the survival mask is in use, said visual portion further includes a de-fogging agent to reduce fogging and increase clarity of the user's vision;

said respiratory portion including filter material comprised of MOLECULITE® and further including a self contained supplementary oxygen supply, said oxygen supply comprised of one or more frangible vials containing a supersaturated perfluorocarbon-oxygen solution, having a low surface tension to permit ready physical diffusion of oxygen, where upon fracture of said one or more said vials, said perfluorocarbon-oxygen solution provides immediate availability of oxygen to the user, said respiratory portion further comprising a respiratory cup-shaped apparatus, wherein said one or more vials of said perfluorocarbon-oxygen solution are embedded within flanking pouches surrounding said respiratory cup-shaped apparatus before rupture, and wherein said respiratory cup-shaped apparatus retains said perfluorocarbon-oxygen solution after rupture of said one or more vials;

a pair of adjustable, resilient straps fixed to opposing sides of the mask body for securing the mask body to a user's face, said straps detachably affixed to each other via traditional hook and loop fasteners;

said visual portion including a transparent window fort covering the eyes of the user;

said mask body further including one or more colors around its inner periphery, each said color corresponding to a different location on the user's face to allow the user to compare the colors of the mask to pictorial instructions to allow for proper orientation of the mask upon the user's face without the need for subsequent removal; and a one-way outlet valve within said cup-shaped apparatus to permit free egress of expired air.

* * * * *

UNITED STATES PATENT AND TRADEMARK OFFICE

CERTIFICATE OF CORRECTION

PATENT NO. : 6,543,450 B1
DATED : April 8, 2003
INVENTOR(S) : John T. Flynn

It is certified that error appears in the above-identified patent and that said Letters Patent is hereby corrected as shown below:

Column 3,
Line 26, should read -- person's eyes are protected…; and
Line 27, should read -- breathing air is available… --.

Column 8,
Line 40, should read -- FIG. 3 is a front… --;
Line 44, delete "FIG. 3B is a detail of flange 8, showing its layered details."; and
Line 51, should read -- FIG. 3 illustrates flange 8… --.

Column 9,
Line 44, should read -- stream of nanoparticles of MOLECULITE … --;
Line 62, should read -- and nanoparticles of MOLECULITE… --.

Column 12,
Line 43, should read -- ...a transparent window for covering… --.

Signed and Sealed this

Twenty-eighth Day of February, 2006

JON W. DUDAS
*Director of the United States Patent and Trademark Office*